US005083936A

United States Patent [19]

Yang

[11] Patent Number: 5,083,936

[45] Date of Patent: Jan. 28, 1992

[54] TERMINAL ASSEMBLY

[76] Inventor: Su-Pei Yang, 2F, No. 110, Lane 103, Sec. 2, Nei Hu Rd., Taipei, Taiwan

[21] Appl. No.: 658,127

[22] Filed: Feb. 22, 1991

[51] Int. Cl.[5] ..... H01R 4/24

[52] U.S. Cl. ..... 439/441; 439/852

[58] Field of Search ..... 439/266, 438–441, 439/828, 829, 851, 861, 862, 842, 843, 852

[56] References Cited

FOREIGN PATENT DOCUMENTS

| | | | |
|---|---|---|---|
| 2002911 | 7/1971 | Fed. Rep. of Germany | 439/438 |
| 2619035 | 11/1977 | Fed. Rep. of Germany | 439/439 |
| 0301919 | 12/1954 | Switzerland | 439/439 |
| 0752568 | 8/1980 | U.S.S.R. | 439/828 |

*Primary Examiner*—David L. Pirlot

*Attorney, Agent, or Firm*—Wenderoth, Lind & Ponack

[57] ABSTRACT

A female member of a terminal assembly, having a conductor clamp formed by means of a punching method. The front end of the conductor clamp has a frame member, the front end of which is provided with a fastening piece extending upwards through an opening in the frame member. A leaf spring is provided on the bottom of the frame member, and the rear end of the frame member is provided with a wire clamp and an insulation clamp so as to grip lightly a wire inserted therein. A corresponding pin from a male member of the terminal assembly can be inserted into the through hole of the fastening piece, and held in place. Also, the pin can be tightly gripped by the leaf spring without being disengaged unintentionally.

3 Claims, 4 Drawing Sheets

TERMINAL ASSEMBLY

BACKGROUND OF THE INVENTION (a). Field of the Invention

This invention relates to a new terminal assembly, in which a conductor clamp is molded integrally. The conductor clamp includes a fastening piece and a leaf spring, whereby a corresponding pin can be gripped in place tightly without being disengaged un-intentionally.

(b). Description of the Prior Art

Each of the conventional terminal structures as shown in FIGS. 1 to 3, comprises a male member 10, a female member 20, a plurality of conductor pins 30 and 40, which are to be assembled together by means of fastening arms 50 and fastening holes 60 in the male and female members 10 and 20 respectively. Since both the male and female members are to be connected together by means of the fastening arms, the size of the whole terminal structure has to be increased so as to occupy a given space; in other words, no matter how many pins the terminal structure has, a given number of fastening arms must be provided, and therefore the structure of the terminal becomes quite complicated which causes a higher manufacturing cost. Moreover, once a male member and a female member are assembled together, they are unable to be disengaged unless the two fastening arms are removed simultaneously; in other words, it is rather difficult to assemble or disassemble.

Further, after a pin is inserted into a pin hole, the pin will be held in place by means of a gripping leaf conductor inside the pin hole; however, the gripping leaf conductor is merely a leaf spring serving as a conductive means, and it has little gripping force to insure a complete conduction; therefore, complete conduction can only be obtained by means of the connection of the male and female members.

SUMMARY OF THE INVENTION

The prime object of the present invention is to provide a new terminal assembly which can be surely and simply connected and which cannot be disengaged un-intentionally; the fastening clamp in the assembly has been improved on a logical basis, i.e., a corresponding pin can be inserted in place to provide a sure connection without being disengaged un-intentionally for the purpose of providing a better quality control.

Another object of the present invention is to provide a new terminal assembly, in which the male and female members have been inproved, so as to have a better fastening by means of a conductor clamp, i.e., there are no fastening arms furnished in the male and female members. Therefore, the size of the terminal assembly can be reduced considerably, and the structure of the same can also be simplified so as to reduce the manufacturing cost, and the storage space therefore is also reduced.

A further object of the present invention is to provide a new terminal assembly, in which the conductor clamp includes a fastening piece and a leaf spring to provide a better gripping result. The fastening piece may be pushed backwards to insert or release a pin therefrom. In other words, the fastening piece can provide fast and easy assembling and disassembling operations.

DETAILED DESCRIPTION

Figure 1:
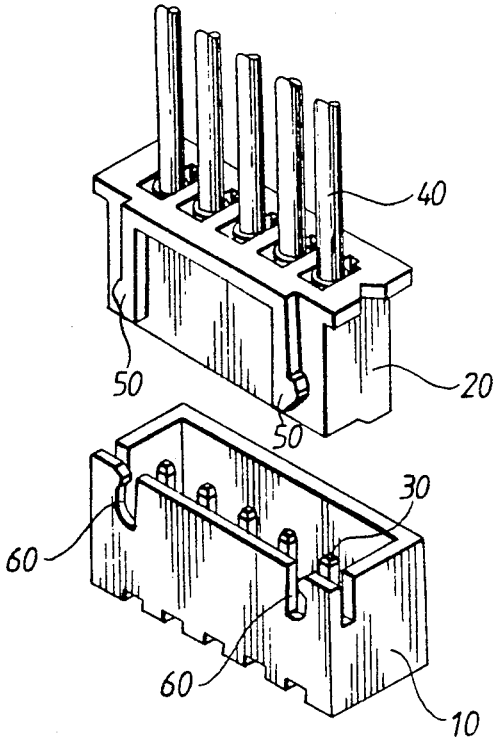
FIG. 1 (PRIOR ART)
FIG. 1 is a perspective view of a conventional terminal assembly.
Figure 2:
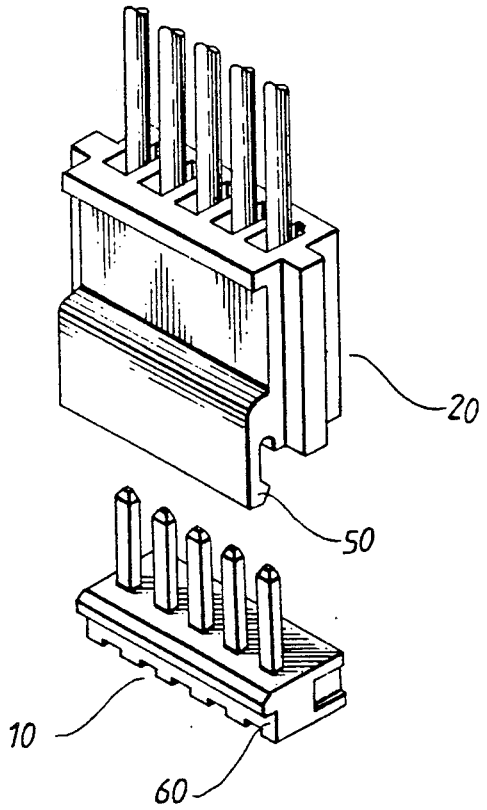
FIG. 2 (PRIOR ART)
FIG. 2 is a perspective view of another conventional terminal assembly.
Figure 3:
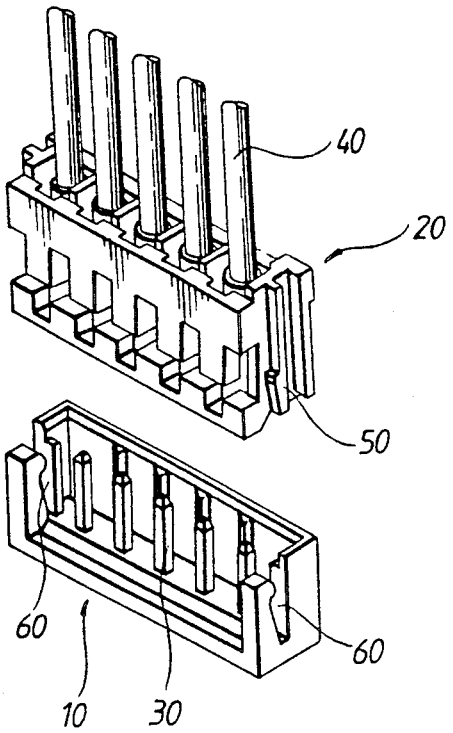
FIG. 3 (PRIOR ART)
FIG. 3 is a perspective view of still another conventional terminal assembly.
Figure 4:
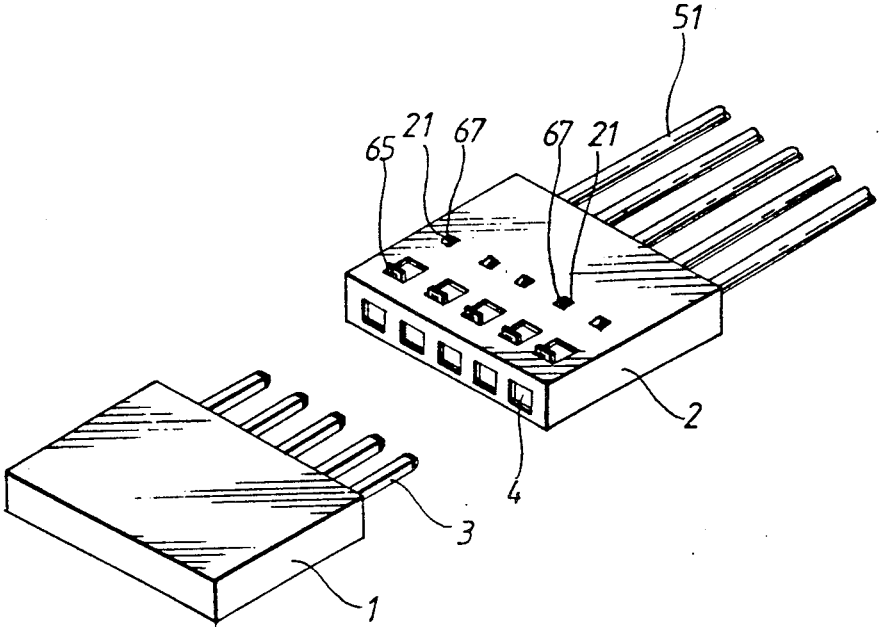
FIG. 4 is a perspective view of an embodiment according to the present invention.
Figure 5:
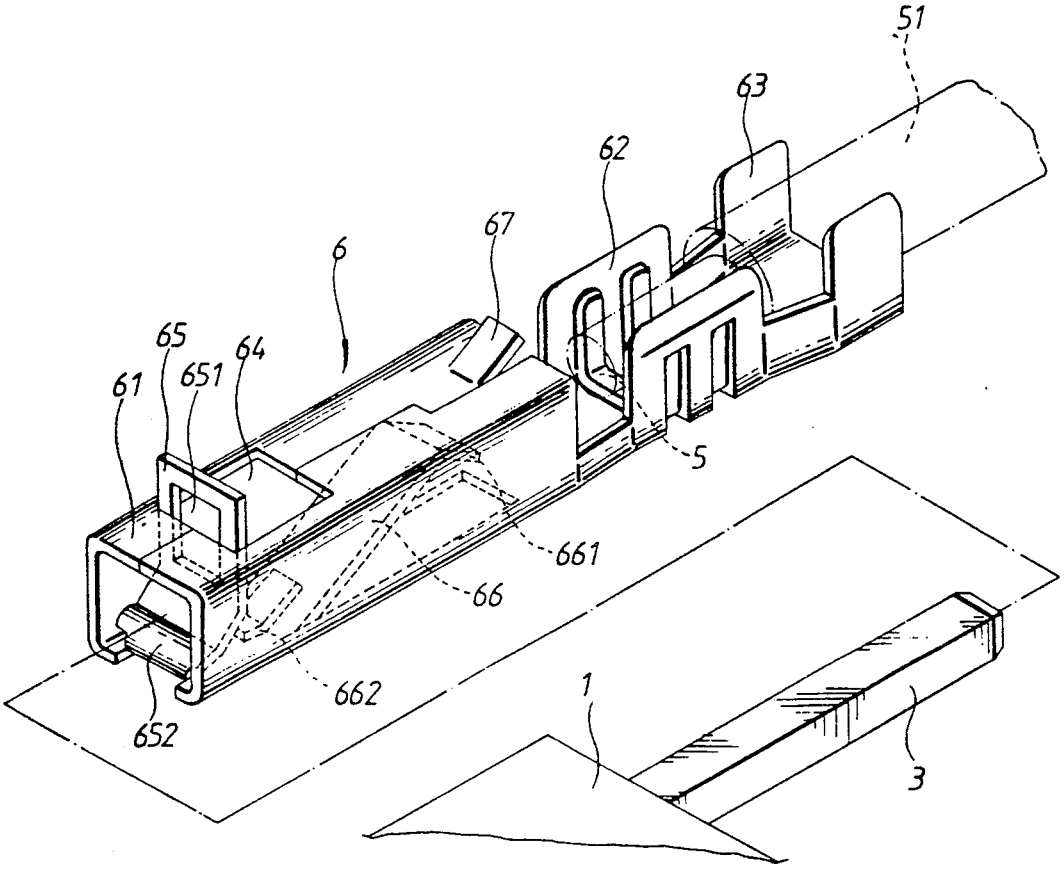
FIG. 5 is a perspective view of the conductor clamp of the present invention.
Figure 6:
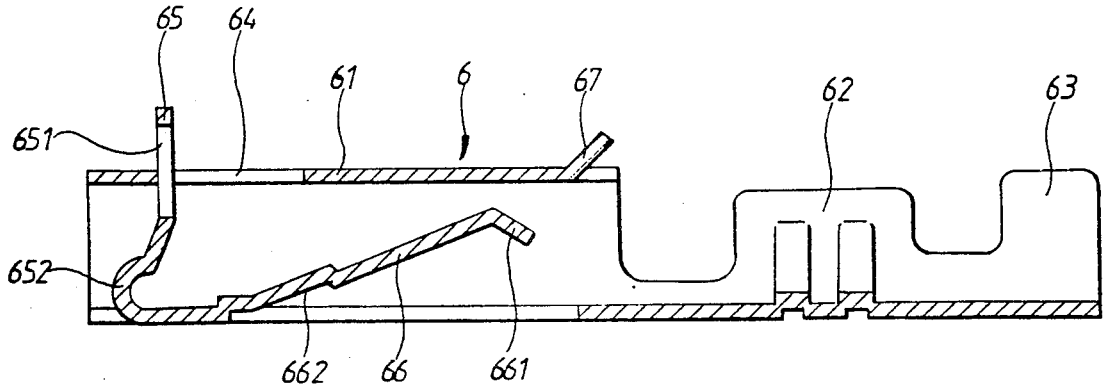
FIG. 6 is a sectional view of the conductor clamp of the present invention.

Referring to FIGS. 4–8, the new terminal assembly according to the present invention comprises a male member 1 with a plurality of corresponding pins 3 and a female member with corresponding holes 4. In each of the corresponding holes 4, there are a wire 51 and a conductor clamp 6. As shown in FIG. 5, the conductor clamp 6 to connected to the wire is substantially a frame member 61 formed by means of a punching machine. The rear end of the conductor clamp has a wire clamp 62 and an insulating clamp 63. The top of the frame member 61 has an opening 64, the bottom of the frame member has a fastening piece 65 with a through hole 651, and the fastening piece 65 is raised at a suitable angle so as to project through the opening 64. The bent part of the fastening piece 65 has a curved portion 652 to provide the fastening piece 65 with a suitable resiliency. The bottom of the frame member 61 is furnished with a leaf spring 66 by means of a punching machine. The leaf spring 66 is set at a suitable elevation angle, and the front end thereof has a bent part 661. The leaf spring 66 has indented portion 662 formed by means of punching so as to increase the lifting force thereof. The wire clamp 62 and the insulation clamp 63 at the rear end of the conductor clamp 6 are for fastening a wire 5 and a wire insulating part 51 in place. The rear end of the frame member 61 has a stop leaf spring 67, which is to be mated with a check hole 21 in the female member 2 for correct positioning.

Figure 7:
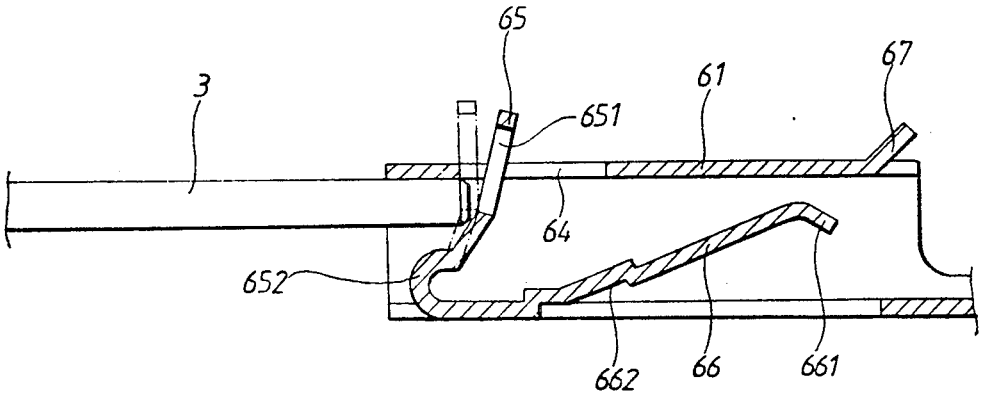
FIG. 7 is a sectional view of the conductor clamp, showing a corresponding pin being inserted in the conductor clamp according to the present invention.
Figure 8:
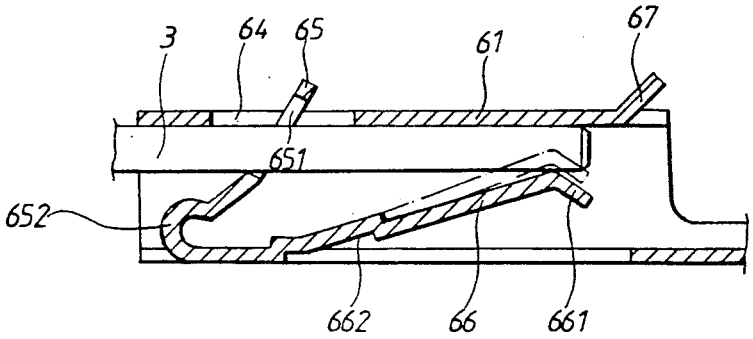
FIG. 8 is a sectional view of a conductor clamp and a corresponding pin connected together.

The fastening piece 65 is placed in the opening 64 of the frame member 61 in such a manner that one part of the through hole 651 of the fastening piece 65 is above the top surface of the frame member 61, while the lower part of the through hole 651 is under the top surface of the frame member 61, and the lower part of the through hole has a size that is slightly less than the diameter of a corresponding pin 3 so as to cause the fastening piece 65 to be pushed in a given distance (as shown in FIG. 7) upon a corresponding pin 3 being inserted into the frame member 61; in such case, the leaf spring 66 is pressed downwards slightly to provide a pushing up force for better electric connection. Since the fastening piece 65 has an inertia resiliency which enables it to recover its original shape, it can tightly grip the corresponding pin 3 in place (as shown in FIG. 8).

To pull the corresponding pin 3 out of the conductor clamp, the fastening piece 65 is simply pushed backwards to release the pin 3 from the through hole 651 smoothly. In other words, the present invention is easy to assemble and disassemble.

I claim:

1. A female member of a terminal assembly which also has a male member with conductive pins, comprising: a conductor clamp having a front end formed into a frame member, and a fastening piece and a leaf spring being provided on a bottom of said frame member, and a wire clamp and an insulating clamp being provided at a rear end of said frame member; and a front end of said frame member having an opening in the top of said frame member, and a front bottom of said frame member having a fastening piece having a front end which has a through hole, and said fastening piece extending upwards at an elevation angle into said opening of said frame member; and said through hole being positioned in and intersected with said opening, a portion of said through hole under said opening being slightly smaller than a diameter of a corresponding pin of the male member so as to facilitate a corresponding pin being inserted into said through hole to force said fastening piece to move downwards while maintaining a pushing up force so as to cause said fastening piece grip said corresponding pin tightly.

2. A new terminal assembly as claimed in claim 1, wherein said fastening piece in said conductor clamp has a suitable curved portion.

3. A new terminal assembly as claimed in claim 1, wherein said frame member in said conductor clamp has a stop leaf spring at a rear end thereof.

* * * * *